US008262813B2

(12) United States Patent
Spaniol

(10) Patent No.: US 8,262,813 B2
(45) Date of Patent: Sep. 11, 2012

(54) OXYGEN-ENRICHED NIOBIUM WIRE

(75) Inventor: Bernd Spaniol, Hammersbach (DE)

(73) Assignee: Heraeus Materials Technology GmbH & Co. KG, Hanau (DE)

( * ) Notice: Subject to any disclaimer, the term of this patent is extended or adjusted under 35 U.S.C. 154(b) by 356 days.

(21) Appl. No.: 11/528,110

(22) Filed: Sep. 27, 2006

(65) Prior Publication Data

US 2007/0017611 A1 Jan. 25, 2007

Related U.S. Application Data

(62) Division of application No. 10/759,692, filed on Jan. 16, 2004, now abandoned.

(30) Foreign Application Priority Data

Feb. 5, 2003 (DE) ..... 103 04 756

(51) Int. Cl.
*C23C 8/10* (2006.01)
*C22C 27/02* (2006.01)

(52) U.S. Cl. ..... 148/281; 148/276; 148/277; 148/422; 148/668; 420/425

(58) Field of Classification Search ..... 148/276, 148/277, 281, 422, 668; 420/425
See application file for complete search history.

(56) References Cited

U.S. PATENT DOCUMENTS

| | | | | |
|---|---|---|---|---|
| 2,987,352 | A | 6/1961 | Watson | |
| 4,526,629 | A * | 7/1985 | Latta et al. | 148/277 |
| 5,098,485 | A * | 3/1992 | Evans | 148/272 |
| 5,242,481 | A | 9/1993 | Kumar | |
| 6,165,623 | A | 12/2000 | Fife et al. | |
| 6,358,625 | B1 | 3/2002 | Kumar et al. | |
| 6,521,173 | B2 * | 2/2003 | Kumar et al. | 419/23 |
| 6,545,858 | B1 * | 4/2003 | Naito et al. | 361/510 |
| 2004/0149356 | A1 | 8/2004 | Spaniol | |
| 2006/0169364 | A1 | 8/2006 | Trotzschel et al. | |

FOREIGN PATENT DOCUMENTS

| | | | |
|---|---|---|---|
| DE | 3700659 | A1 | 7/1987 |
| JP | 63090315 | A | 4/1988 |
| JP | 7183167 | A | 7/1995 |
| JP | 11264064 | A | 9/1999 |
| JP | 2002507247 | T | 3/2002 |
| WO | 02/098275 | A2 | 12/2002 |
| WO | 03/008657 | A1 | 1/2003 |

OTHER PUBLICATIONS

Arfaoui et al. "Evidence for a large enrichment of interstitial oxygen atoms in the nanometer-thick metal layer at the NbO/Nb (110) interface", Journal of Applied Physics, vol. 91, No. 11, Jun. 1, 2002.*
R.A. Perkins and R.A. Padgett, Jr., "Oxygen Diffusion in Niobium and Nb-Zr Alloys", Acta Metallurgica, vol. 25, Issue 10, pp. 1221-1230, Pergamon Press, 1977.*
Office Action Issued Jan. 11, 2007 in U.S. Appl. No. 10/759,692.
Office Action Issued Aug. 24, 2006 in U.S. Appl. No. 10/759,692.
Espe, "Materials Science of High-Vacuum Technology", VEB German Publisher of the German Sciences, vol. 1, pp. 146-149 (1959).
Cost, "On the Existence of Interstital Clustering of Oxygen in Nb-O Solid Solutions", Acta Metall., vol. 32, No. 1, pp. 123-130 (1984).
Office Action issued Mar. 15, 2011 in U.S. Appl. No. 11/279,669.
Office Action issued Jun. 24, 2010 in U.S. Appl. No. 11/279,669.
Office Action issued Jul. 30, 2009 in U.S. Appl. No. 11/279,669.
Office Action issued Dec. 1, 2008 in U.S. Appl. No. 11/279,669.

* cited by examiner

*Primary Examiner* — Lois Zheng
(74) *Attorney, Agent, or Firm* — Panitch Schwarze Belisario & Nadel LLP

(57) ABSTRACT

A process for providing a niobium wire and its use for connection to niobium or niobium oxide capacitors. The wire is enriched with oxygen and preferably has oxygen concentrations of about 3,000 to 30,000 μg/g.

4 Claims, No Drawings

OXYGEN-ENRICHED NIOBIUM WIRE

This is a Divisional of U.S. patent application Ser. No. 10/759,692 filed Jan. 16, 2004 now abandoned. Priority is claimed on that application and on the following application:

Country: Germany, Application No. 103 04 756.5, filed Feb. 5, 2003

BACKGROUND OF THE INVENTION

The invention concerns a novel niobium wire, a process for producing it, and its use for connection to niobium or niobium oxide capacitors.

Wires made of refractory metals are used for the electrical connection of metal powder capacitors. Tantalum wires are generally used for this purpose. This has the disadvantage of a relatively high sintering temperature. As a result, the surface of the powder anode cannot be completely used, because the powder partially sinters together. Furthermore, the use of tantalum wires with niobium and niobium oxide capacitors results in non-recyclable waste. Moreover, the price of tantalum is subject to considerable speculation, so that the costs for the raw material are difficult to calculate and control.

Niobium wires have already been recommended for the connection of powder anodes. For example, U.S. Pat. No. 6,358,625 B1 describes anode wires made of niobium or tantalum, which, to improve adhesion, are treated with oxygen in such a way that surface enrichment on the order of 35 atom % in a thickness of about 50 nm is obtained. Niobium and tantalum wires normally contain only small amounts of oxygen. Oxygen concentrations of 50-300 μg/g are specified for tantalum. The surface enrichment does not affect the general properties, such as conductivity, but increases adhesion. Sintering temperatures around 1,250° C. are specified.

SUMMARY AND DESCRIPTION OF THE INVENTION

The object of the present invention is to provide thermally stable niobium wires in the range of 1,200 to 1,400° C.

This object is achieved by niobium wire that is highly enriched with oxygen. The oxygen concentration is preferably about 3,000 to 30,000 μg/g. The wires are suitable for connection especially to niobium or niobium oxide capacitors.

It is assumed that the interstitial impurities reduce the lattice mobility and block the grain boundaries in such a way that coarse grain development at the sintering temperature of the powder anodes is reduced.

The production process involves loading the niobium with oxygen by diffusion processes at elevated temperatures of preferably 600 to about 800° C. and pressures below 5 mbars. This is usually done in an oxygen-containing atmosphere, e.g., in pure oxygen or oxygen-containing gas mixtures, such as air. This yields a temperature-stabilized niobium alloy, which at 1,400° C. has no appreciable vapor pressure of metals that can have a negative effect on the stability (dielectric) of the $Nb_2O_5$ layer by being deposited on the anode bodies. The alloy can be worked at room temperature into wire 0.2-0.4 mm in diameter.

The wires are preferably used as lead wires in niobium or niobium oxide capacitors. Capacitors of this type are produced from metallic niobium powder in the same way that tantalum capacitors are produced. After sintering (together with the wire), the metallic niobium is "formed," i.e., anodically oxidized, on the surface to form an extremely thin dielectric $Nb_2O_5$ layer.

The following example explains the invention in greater detail without limiting it.

EXAMPLE

Niobium in the form of prewire is loaded with oxygen at temperatures of 600-800° C. and pressures below 5 mbars in such a way that, as a result of the simultaneously occurring diffusion processes, oxygen enrichment occurs with respect to the (wire) bulk. This results in a niobium alloy with oxygen concentrations of 3,000 to 30,000 μg/g. The niobium alloy produced in this way is drawn into wires 0.2-0.4 mm in diameter at room temperature.

While the oxygen-enriched niobium wire has been described in conjunction with specific embodiments, it is evident that many alternatives, modifications and variations will be apparent to those skilled in the art in light of the disclosure herein. It is intended that the meets and bounds of the invention be determined by the appended claims rather than by the language of the above specification, and that all such alternatives, modifications and variations which form a function or co-jointly or cooperative equivalent are intended to be included within the spirit and scope of these claims.

The invention claimed is:

1. A process for producing oxygen-enriched niobium wire, comprising the steps of: treating a niobium pre-wire in an oxygen-containing atmosphere in a closed chamber at an elevated temperature of 600-800° C. at a pressure below 5 mBars until the bulk of the niobium pre-wire is enriched with 3000 to 30,000 μg/g oxygen; and drawing the niobium treated in this way into wire.

2. A process in accordance with claim 1, wherein the treating step is carried out in an atmosphere of air.

3. A process in accordance with claim 1, wherein the drawing step includes drawing the niobium into wire having a diameter of 0.2-0.4 mm.

4. A process in accordance with claim 1, wherein the drawing step is carried out at room temperature.

* * * * *